United States Patent [19]

Zetlmeisl et al.

[11] 3,980,449

[45] Sept. 14, 1976

[54] INHIBITION OF LEAD CORROSION

[75] Inventors: Michael J. Zetlmeisl; Walter R. May; Robert R. Annand, all of St. Louis, Mo.

[73] Assignee: Petrolite Corporation, St. Louis, Mo.

[22] Filed: July 25, 1974

[21] Appl. No.: 491,770

[52] U.S. Cl. ..... 44/68; 44/DIG. 3; 44/76

[51] Int. Cl.[2] ..... C10L 1/26

[58] Field of Search ..... 44/51, 68, 76, DIG. 3

[56] References Cited

UNITED STATES PATENTS

| | | | |
|---|---|---|---|
| 3,817,722 | 6/1974 | Scott | 44/DIG. 3 |

FOREIGN PATENTS OR APPLICATIONS

| | | | |
|---|---|---|---|
| 200,149 | 11/1955 | Australia | 44/DIG. 3 |
| 200,447 | 11/1955 | Australia | 44/DIG. 3 |
| 744,141 | 2/1956 | United Kingdom | 44/DIG. 3 |

*Primary Examiner*—Robert V. Hines
*Assistant Examiner*—Y. Harris-Smith
*Attorney, Agent, or Firm*—Sidney B. Ring; Hyman F. Glass

[57] ABSTRACT

This invention relates to the inhibition of lead corrosion in fuel, for example, in residual fuels, such as in those fuels used in steam boilers and gas turbines, by adding certain metals thereto such as magnesium, calcium, aluminum, silicon, and combinations thereof.

22 Claims, No Drawings

INHIBITION OF LEAD CORROSION

The demand for greatly increased amounts of energy has forced utilities and other large-quantity users of fossil fuels to explore low-quality fuels for use in steam boilers and gas turbines. Fuels such as unrefined crude oil and residual oil contain large amounts of impurities which result in corrosive deposits in the equipment. Two of these impurities, sodium and vanadium, form catastrophically corrosive, low melting slags that can destroy a vital part in a matter of hours.

Crude oil usually contains 1–500 ppm of vanadium in the form of a porphyrin complex depending on the source. Because of its origin as a concentrate from the refining process, residual oil contains several times more vanadium than the crude from which it was derived. The combustion of these vanadium-containing fuels produces very corrosive $V_2O_5$ deposits which can destroy a turbine part in a matter of days. Although the vanadium can be removed, the cost of the process cancels the economic advantage of using unrefined fuels. Vanadic corrosion is, therefore, usually controlled with chemical additives and optimization of operating conditions.

Sodium is almost always present in low-quality fuels, either directly in the crude oil or indirectly through contamination from various sources. The technology for removing sodium is well developed. These are limiting processes, however, and a trace of sodium must always be dealt with. For example, in maritime use the sodium level can be increased because of the introduction of sodium chloride through the air intake and contamination of the fuel by sea water. During combustion, the sodium reacts with the sulfur in the fuel to form the sulfate which is deposited in turbine parts. This reaction has been shown to be thermodynamically favored and results in the only sodium compound that will deposit under these conditions.

The mechanism of corrosion by vanadium and sodium has received much attention. Nascent oxygen species has been proposed as the corrosive active agent in $V_2O_5$ melts. Various mechanisms have been presented to explain corrosive attack by sodium sulfate at metal surfaces. The classical method of inhibiting the corrosive characteristics of $V_2O_5$ and $Na_2SO_4$ melts has been to form high-melting vanadates of the former and minimize the level of the latter. Magnesium has been the most successful substance for this type of protection. The optimum levels of magnesium addition are not precisely known. Just as the mechanism of corrosion is only partially understood, so too is that of its inhibition.

There are other methods of limiting the corrosion such as reducing the operating temperature and maintaining the air to fuel ratio so that slightly reducing conditions exist during combustion. These types of methods may not be applicable. For example, the air to fuel ratio cannot be lowered to obtain reducing conditions in a gas turbine. Lower operating temperatures make the system less efficient and may be ruled out for economic reasons. Thus, chemical additives are often the best way to inhibit corrosion.

As indicated by the ASTM Designation D-2880-71 lead is recognized as a corrosive agent in fuels for gas turbines and steam boilers when present as lead alone, or in combination with vanadium and sodium. We have now discovered that the presence of certain metals in the residual fuels, such as magnesium, calcium, aluminum, silicon and combinations thereof, inhibit such corrosion.

We have discovered that Mg and Mg/Si combinations inhibit lead corrosion when impure fuels are burnt in gas turbines and steam boilers.

We have discovered that to inhibit lead alone at 850°–900°C. preferably about 3 parts by weight of Mg be present in the resulting slag for each part of Pb, when the Na/Pb ratio is 0.1 or less, whether Pb is present as the sulfate or the oxide.

We have also discovered that the Mg/Si combination will inhibit Pb corrosion at an Mg/Pb ratio of preferably at least about 1.5 and a Si/Pb ratio of preferably at least about 1.5 provided the Na/Pb ratio is about 0.1 or less.

We have also discovered that where Pb and V are present in the fuel the Mg/(Pb + V) ratio should preferably be at least about 3.

We have also discovered that where Si is present in the corrosion inhibitor, the (Mg + Si)/(Pb + V) ratio should preferably be at least about 4, where the Na/(Pb + V) ratio is about 0.1 to .125 at 800°–850°C.

We have discovered that at 850°–900°C., if the Na/(Pb + V) = 0.01, less corrosion inhibiting additive can be employed, but it is preferred that the $$\frac{Mg+Si}{Pb+V}$$

ratio preferably be at least about 4, but to lower the sodium content as low as possible.

We have discovered that the presence of Si reduces the stickiness and adherency of Pb corrosion products. Thus, although Mg reduces corrosion, the presence of Si produces a softer, more friable slag which is easier to remove.

We have also discovered the Ca/Al combination is also effective in inhibiting lead and lead-vanadium corrosion where the $$\frac{Ca+Al}{Pb} \text{ or } \frac{Ca+Al}{(Pb+V)}$$

ratio is preferably at least about 3 at a $$\frac{Na}{Pb} \text{ or } \frac{Na}{(Pb+V)}$$

ratio of less than about 0.1. Silicon can be added to reduce the adherency of the slag at a ratio of Si/Pb = 1 to 4, depending on the temperature and sodium level.

The corrosion rates of materials used in gas turbine, furnace and steam boiler construction in sodium-vanadium-sulfur containing slags may be determined by a variety of methods. The most reliable method is a field test in operating equipment. However, because of the costs involved, a variety of tests have been designed to either duplicate or reflect actual field conditions. These range from high-pressure test rigs which are similar to gas turbines on a smaller scale to simple crucible tests carried out in a laboratory muffle furnace. We have developed an electrochemical technique for measuring corrosion rates in a laboratory scale furnace that accurately reflects the situation observed in larger test facilities and in the field. This technique is described in the article "High-Temperature Corrosion in Gas Turbines and Steam Boilers by Fuel Impurities. I. Measurement of Nickel Alloy Corrosion Rate in Molten Salts by Linear Polarization Technique," by Walter R. May, et al., *Industrial and Engineering Chemistry, Product Research and Development*, Vol. 11, No. 4, pg, 438, 1972. The data presented below in support of this disclosure was obtained by this technique. Good correlation has been found between data from this test and field data. Data on magnesium are published in the articles "High-Temperature Corrosion in Gas Turbines and Steam Boilers by Fuel Impurities. II. The Sodium Sulfate-Magnesium Sulfate-Vanadium Pentoxide System" and "III. Evaluation of Magnesium as a Corrosion Inhibitor," *Industrial and Engineering Chemistry*, Vol. 12, No. 2, pgs. 140–149, 1973.

Corrosion data obtained by the above procedure is presented and discussed below.

Since the above procedure gives a good approximation of the corrosion rate on Udimet-500 Alloy, we evaluated synthetic slags to find conditions in which Mg or Mg/Si will inhibit corrosion on this alloy. Employing magnesium and using PbO as the lead source, slags were screened at varying Na/Pb ratios. It was found the corrosion could be inhibited by magnesium, and although molten PbO alone is much more corrosive than molten $V_2O_5$ alone, a Mg/Pb ratio of 3 gave good inhibition even at the relatively high sodium level of Na/Pb=0.1. This effect is apparently due to the higher melting regime of lead. The data are presented in Table I. Note that the rate for uninhibited systems is several orders of magnitude higher than that desired for exposure to turbine components.

The "Maximum Acceptable Corrosion Rate" involving corrosion rate versus temperature corresponds to a 20 mils per year corrosion rate. An acceptable life for a turbine bucket or nozzle is 3 years which is approximately 40 mils per year. Since our tests have an accuracy within a factor of 2, we have designated the 20 mils per year rate as our target which is 0.05 ma/cm$^2$ corrosion current density for Udimet 500 alloy. In some industrial applications, higher rates could be allowable based on economic considerations.

To test the corrosivity of $PbSO_4$ in comparison to PbO and as a closer approximation to high sulfur fuel, the data presented in Table II was obtained. There is no great difference between the two sets of data other than that the $PbSO_4$ rates are somewhat higher than the PbO.

Mg-Si mixtures were tested. The corrosion rate screening data are presented in Table III. The dosage levels for adequate inhibition by Mg-Si is about the same as for Mg alone, i.e. (Mg+Si)/Pb=3. Moreover, the data for $PbSO_4$ were similar but somewhat higher than the PbO data.

Although corrosion by lead alone may be a serious problem for the internal combustion engine manufacturer, the more common problem for the turbine and boiler industry involves mixtures of lead, sodium, vanadium and other substances. We chose Pb/V=1 as a typical mixture and varied the sodium level over the range encountered. These data are presented in Table IV. It is clear from these data that magnesium is barely adequate as an inhibitor of lead-vanadium mixtures even at the low sodium level of Na/(Pb+V)=.01. As the temperature approaches 900°C., moreover, magnesium alone no longer suffices as an inhibitor even at a dosage rate of Mg/(Pb+V)=5. Thus magnesium can be used effectively at a 4/1 ratio up to 850°C. at a sodium level of Na/Pb+V<.1.

At higher temperatures, Mg/Si is useful. The corrosion data are presented in Table V. These data show that a treatment rate of (Mg+Si)/(Pb+V)=4 will give adequate protection in the 800°–850°C. range even at the relatively high sodium level of Na/(Pb+V)=0.125. To get adequate protection at higher temperatures than 850°, we must either remove more of the sodium or add considerably more additive. Specifically, the sodium level must be such that Na/(Pb+V)=0.01 or a dosage rate of (Mg+Si)/(Pb+V)=6 or 7 must be employed.

In addition to the corrosion data, we have also examined the effect of magnesium and Mg/Si oil soluble additives on the capture efficiency or slagging tendency of lead containing fuels. The technique used for this is described in the article "High-Temperature Corrosion in Gas Turbines and Steam Boilers by Fuel Impurities. IV. Evaluation of Silicon and Magnesium-silicon as corrosion inhibitors" by Walter R. May, et al., *Journal of Engineering for Power*, Vol. 96, No. 2, pp 124, 1974. The data in Table VI presents a comparison of (Mg+Si)/(Pb+V)=4 and Mg/(Pb+V)=7 at 800°C. It is obvious that the Mg/Si combinations produce a much softer, more friable slag than the Mg alone. The general increase in tenacity with sodium level is also observed, as well as some aggravation of slagging with increasing lead level. It is also clear from a comparison of the data that little is gained from the slagging point of view by treating at a (Mg+Si)/(Pb+V)=7 rate in comparison to 4 at 800°C. Data for friability obtained at 900°C. is presented in Table VII. The 100°C. increase in temperature produced much harder slags. The Mg/Si additive produced much more friable slag than Mg alone. The sodium effect was much more pronounced. By increasing the additive/vanadium ratio from 4 to 6, the slag friability was increased to a more acceptable level at this temperature.

In terms of operating conditions, the data presented indicates that treatment of the fuel for vanadium-lead, accompanied by water-washing for removing sodium will adequately control corrosion. For a metal temperature of 800° and a combined vanadium-lead level of 50 ppm, it is desirable to reduce the sodium content to 5 ppm and add 200 ppm of Mg or Mg/Si. The Mg/Si combination yields a much more friable slag. To operate at 900°C., the sodium level is reduced to 0.5 ppm with 200 ppm additive or 5 ppm sodium with 300 ppm additive.

In addition to Mg and Mg/Si combination, Ca/Al has been found to inhibit lead corrosion when the lead is present as either the oxide or the sulfate. The data are presented in Tables VIII and IX. From these data it is apparent that Ca/Al will inhibit lead corrosion when sodium is as high as Na/Pb=0.1, when a dosage rate of Ca/Pb=1.5 plus Al/Pb=1.5 is used. Silicon added to the fuel so as to give a ratio of Si/Pb=3 gave easily washable slags. Calcium-aluminum mixtures will also provide corrosion protection in lead vanadium containing fuels when a minimum ratio of Ca/(Pb=V)=1.5 and Al/(Pb+V)=1.5 is used. Moreover, as in the cases above, silicon will provide easily washable slags when present at a ratio of Si/(Pb+V)=1 to 4.

Data available indicates similar beneficial effects when lead and lead-vanadium containing fuels are treated with aluminum, magnesium-aluminum and magnesium-aluminum-silicon combinations. With lead alone present a ratio of Al/Pb=2 to 4 is needed depending on temperature and the level of protection desired. Magnesium-aluminum combinations should be added so that Mg/Pb=1 and Al/Pb=1 at low sodium levels (Na/Pb=0.01) and low temperature. At high temperatures (850°-900°C) ratios as high as Mg/Pb=4 and Al/Pb=4 would be required. Silicon added in combination with Mg-Al, at levels from Si/Pb=1 to 4, depending on the temperature and sodium level will produce easily washable slags. For fuels containing lead plus vanadium, aluminum alone should be added in sufficient amount to give a ratio of Al/(Pb+V)=2 for less severe conditions of temperature (750°-800°C) and sodium level (Na/(Pb+V)=0.01) and as much as Al/(Pb+V)=5 or 6 for higher temperature (850°-900°C) and sodium level (Na/(Pb+V)=0.1). When magnesium-aluminum combinations are used to combat lead-vanadium corrosion, the ratios should be such that Mg/(Pb+V) ranges from 1 to 4 and Al/(Pb+V) ranges from 1 to 4 in the same manner as described for lead alone. Moreover, silicon can be used in combination with Mg-Al in lead-vanadium fuels in the same manner as described above for lead alone fuels, in order to produce easily washable slags.

It will be apparent that various changes and modifications may be made in this invention described herein without departing from the scope of this invention. It is intended, therefore, that all matter contained herein shall be interpreted as illustrative and not limitative.

TABLE I

CORROSION RATE DATA FOR UDIMET 500 IN SODIUM SULFATE — MAGNESIUM SULFATE — LEAD OXIDE SLAGS

| Ratio | | Icorr (Ma/Cm²) | | | | Slag |
|---|---|---|---|---|---|---|
| Na/Pb | Mg/Pb | 800° | 850° | 900° | 950°C | Washability* |
| 10 | 1 | .304 | .502 | .772 | 1.51 | Poor |
| 10 | 3 | 2.71 | 3.53 | 3.89 | 6.91 | Poor |
| 10 | 5 | 1.44 | 1.95 | 2.88 | 5.36 | Poor |
| 1 | 1 | 2.82 | 4.65 | 6.20 | 7.18 | Poor |
| 1 | 3 | .096 | .302 | .93 | 1.71 | Poor |
| 1 | 5 | .027 | 1.01 | 2.03 | 3.87 | Poor |
| 0.1 | 1 | .217 | .302 | .356 | .631 | Fair |
| 0.1 | 3 | .0081 | .0135 | .0296 | .0862 | Good |
| 0.1 | 5 | .0032 | .0064 | .0128 | .032 | Good |
| 0.01 | 1 | .0013 | .0013 | .0026 | .0052 | Good |
| 0.01 | 3 | .020 | .023 | .0314 | .023 | Good |
| 0.01 | 5 | .0028 | .0112 | .0056 | .126 | Good |

*Slag Washability: good, washed in less than 1 hr.; fair, washed after several hours of soaking; poor, did not wash.

TABLE II

CORROSION RATE DATA FOR UDIMET 500 IN SODIUM SULFATE — MAGNESIUM SULFATE-LEAD SULFATE SLAGS

| Ratio | | Icorr (Ma/Cm²) | | | | Slag |
|---|---|---|---|---|---|---|
| Na/Pb | Mg/Pb | 800° | 850° | 900° | 950°C | Washability |
| 10 | 1 | 3.12 | 3.87 | 5.16 | 7.61 | Poor |
| 10 | 3 | 5.0 | 6.5 | 10.2 | 14.2 | Poor |
| 10 | 5 | .0923 | .166 | .518 | 2.01 | Poor |
| 1 | 1 | .59 | .935 | 1.56 | 2.70 | Poor |
| 1 | 3 | .519 | .910 | 1.79 | 3.98 | Poor |
| 1 | 5 | .091 | .096 | .338 | .689 | Poor |
| 0.1 | 1 | .0178 | .090 | .165 | .330 | Poor |
| 0.1 | 3 | .0062 | .0175 | .0436 | .299 | Good |
| 0.1 | 5 | .0028 | .0028 | .0056 | .028 | Good |
| 0.01 | 1 | <.0015 | <.0015 | <.0015 | <.0054 | Good |
| 0.01 | 3 | .003 | .0044 | .0162 | .0295 | Good |
| 0.01 | 5 | — | — | .00275 | .0055 | Good |

TABLE III

CORROSION RATE DATA FOR UDIMET 500 IN SODIUM SULFATE — MAGNESIUM SULFATE SILICA — LEAD OXIDE SLAGS

| Ratio | | | Icorr (Ma/Cm²) | | | | Slag |
|---|---|---|---|---|---|---|---|
| Na/Pb | Mg/Pb | Si/Pb | 800° | 850° | 900° | 950°C | Washability |
| 10 | 0.5 | 0.5 | 2.39 | 3.35 | 9.56 | 14.4 | Poor |
| 10 | 1.5 | 1.5 | .219 | .418 | .678 | 1.40 | Poor |
| 10 | 2.5 | 2.5 | .213 | .386 | .773 | 1.35 | Poor |
| 1 | 0.5 | 0.5 | .136 | .440 | .815 | 1.52 | Poor |
| 1 | 1.5 | 1.5 | .119 | .132 | .181 | .602 | Poor |
| 1 | 2.5 | 2.5 | .387 | .506 | .595 | .774 | Poor |
| 0.1 | 0.5 | 0.5 | .216 | .286 | .459 | .683 | Poor |
| 0.1 | 1.5 | 1.5 | .0661 | .0991 | .201 | .358 | Good |
| 0.1 | 2.5 | 2.5 | .071 | .112 | .205 | .30 | Good |
| 0.01 | 0.5 | 0.5 | .0028 | .0028 | .0168 | .042 | Good |
| 0.01 | 1.5 | 1.5 | .0058 | .0058 | .0058 | .0087 | Good |
| 0.01 | 2.5 | 2.5 | — | — | — | .0039 | Good |

TABLE IV

CORROSION RATE DATA FOR UDIMET 500 IN SODIUM SULFATE — MAGNESIUM SULFATE LEAD OXIDE — VANADIUM PENTOXIDE SLAGS

| Ratio | | | Icorr (Ma/Cm²) | | | |
|---|---|---|---|---|---|---|
| Na/V | Mg/Pb + V | Pb/V | 800° | 850° | 900° | 950°C |
| 10 | 3 | 1 | .180 | 520 | 1.22 | 1.65 |
| 10 | 4 | 1 | .207 | .420 | .690 | 1.07 |
| 10 | 5 | 1 | .353 | .411 | 1.09 | 1.32 |

TABLE IV-continued

CORROSION RATE DATA FOR UDIMET 500 IN SODIUM SULFATE — MAGNESIUM SULFATE LEAD OXIDE — VANADIUM PENTOXIDE SLAGS

| Ratio | | | Icorr (Ma/Cm²) | | | |
|---|---|---|---|---|---|---|
| Na/V | Mg/Pb + V | Pb/V | 800° | 850° | 900° | 950°C |
| 1 | 3 | 1 | .740 | 2.02 | 2.52 | 3.87 |
| 1 | 4 | 1 | .639 | 1.39 | 2.03 | 3.92 |
| 1 | 5 | 1 | .892 | 1.28 | 1.91 | 3.35 |
| .1 | 3 | 1 | .238 | .566 | 1.16 | 1.53 |
| .1 | 4 | 1 | .035 | .064 | .122 | .385 |

TABLE IV-continued

CORROSION RATE DATA FOR UDIMET 500 IN SODIUM SULFATE — MAGNESIUM SULFATE LEAD OXIDE — VANADIUM PENTOXIDE SLAGS

| Ratio | | | Icorr (Ma/Cm²) | | | |
|---|---|---|---|---|---|---|
| Na/V | Mg/Pb + V | Pb/V | 800° | 850° | 900° | 950°C |
| .1 | 5 | 1 | .055 | .082 | .197 | .299 |
| .01 | 3 | 1 | .156 | .372 | 1.15 | 1.46 |
| .01 | 4 | 1 | .016 | .063 | .316 | .923 |
| .01 | 5 | 1 | .027 | .085 | .172 | .437 |

TABLE V

Corrosion Rate Data for Udimet 500 in Sodium Sulfate — Lead Oxide — Magnesium Sulfate — Silica — Vanadium Pentoxide Slags

| $\frac{\text{Metal}}{\text{Pb + V}}$ Ratio | | | Corrosion Current (Ma/Cm²) | | | |
|---|---|---|---|---|---|---|
| Na | Si | Mg | 800° | 850° | 900° | 950°C |
| .1 | 2 | 2 | .045 | .073 | .128 | .309 |
| .1 | 3 | 3 | .0053 | .007 | .009 | .055 |
| .1 | 4 | 4 | .0054 | .0090 | .018 | .036 |
| .1 | 5 | 5 | .0054 | .011 | .018 | .038 |
| .125 | 0 | 0 | 36.63 | 51.28 | 61.35 | 58.60 |
| .125 | 2 | 2 | .036 | 0.54 | .090 | .148 |
| .125 | 3 | 3 | .029 | .051 | .093 | .169 |
| .125 | 4 | 4 | .0036 | .0054 | .0072 | .011 |
| .125 | 5 | 5 | .0018 | .0036 | .011 | .027 |
| .01 | 0 | 0 | 36.8618 | 40.55 | 51.61 | 53.45 |
| .01 | 1 | 1 | .035 | .050 | .064 | .092 |
| .01 | 2 | 2 | .0018 | .0054 | .0090 | .018 |
| .01 | 3 | 3 | .0012 | .0018 | .0036 | .0090 |
| .01 | 4 | 4 | .0013 | .0024 | .0054 | .011 |
| .01 | 5 | 5 | .00017 | .00084 | .0012 | .0034 |

TABLE VI

Characteristics of Slags Generated at 800°C

| Na/Pb + V Ratio | Wt. Deposit (mg) | $\frac{\text{Wt. Deposit}}{\text{Surface Area}}$ (mg/cm²) | % Loss on Brushing |
|---|---|---|---|
| | | $\frac{\text{Mg + Si}}{\text{Pb + V}} = 4,\ \frac{\text{Pb}}{\text{V}} = .5$ | |
| .0 | 4.2 | .59 | 73.8 |
| .01 | 3.6 | .56 | 83.3 |
| .1 | 4.0 | .53 | 72.5 |
| .125 | 3.3 | .57 | 66.6 |
| 1 | 3.1 | .53 | 71.0 |
| | | | Average % Loss = 73.44 |
| | | $\frac{\text{Mg + Si}}{\text{Pb + V}} = 4,\ \frac{\text{Pb}}{\text{V}} = 1$ | |
| 0 | 3.5 | .54 | 62.8 |
| .01 | 2.5 | .40 | 52 |
| .1 | 2.1 | .33 | 66.6 |
| .125 | 2.4 | .41 | 66.6 |
| 1 | 3.6 | .48 | 33.3 |
| | | | Average % Loss = 50.26 |
| | | $\frac{\text{Mg + Si}}{\text{Pb + V}} = 4,\ \frac{\text{Pb}}{\text{V}} = 1.5$ | |
| .0 | 4.5 | .71 | 46.7 |
| .01 | 3.8 | .59 | 68.4 |
| .1 | 3.3 | .57 | 75.8 |
| .125 | 4.2 | .65 | 66.6 |
| 1 | 7.1 | 1.11 | 7.0 |
| | | | Average % Loss = 52.9 |
| | | $\frac{\text{Mg}}{\text{Pb + V}} = 4,\ \frac{\text{Pb}}{\text{V}} = 1$ | |
| 0 | 5.0 | .70 | 14.0 |
| .01 | 4.2 | .56 | 7.14 |
| .1 | 4.3 | .74 | 13.95 |
| .125 | 6.2 | 1.07 | 9.68 |
| 1 | 7.2 | 1.13 | 0 |
| | | | average % Loss = 6.95 |
| | | $\frac{\text{Mg + Si}}{\text{Pb + V}} = 7,\ \frac{\text{Pb}}{\text{V}} = .5$ | |
| 0 | 5.5 | .95 | 74.5 |
| .01 | 6.5 | 1.00 | 69.2 |

TABLE VI-continued

| Characteristics of Slags Generated at 800°C | | | |
|---|---|---|---|
| Na/Pb + V Ratio | Wt. Deposit (mg) | $\frac{\text{Wt. Deposit}}{\text{Surface Area}}$ (mg/cm²) | % Loss on Brushing |
| .1 | 5.5 | .76 | 74.5 |
| .125 | 4.2 | .66 | 78.6 |
| 1 | 4.1 | .54 | 78.0 |
| | | | Average % Loss = 74.96 |
| | $\frac{Mg + Si}{Pb + V} = 7$, $\frac{Pb}{V} = 1$ | | |
| 0 | 6.5 | 1.02 | 70.7 |
| .01 | 5.0 | .78 | 74.0 |
| .1 | 5.5 | .84 | 69.1 |
| .125 | 4.2 | .73 | 83.3 |
| 1 | 5.1 | .68 | 68.6 |
| | | | Average % Loss = 73.14 |
| | $\frac{Mg + Si}{Pb + V} = 7$, $\frac{Pb}{V} = 1.5$ | | |
| 0 | 12.2 | 1.97 | 75.4 |
| .01 | 5.0 | .79 | 68.0 |
| .1 | 11.8 | 1.82 | 84.7 |
| .125 | 5.9 | .92 | 67.8 |
| 1 | 5.8 | 1 | 70.7 |
| | | | Average % Loss = 73.32 |
| | $\frac{Mg}{Pb + V} = 7$, $\frac{Pb}{V} = 1$ | | |
| 0 | 6.6 | .86 | 40.9 |
| .01 | 6.9 | 1.07 | 58.0 |
| .1 | 7.3 | .97 | 52.1 |
| .125 | 6.7 | 1.03 | 43.3 |
| 1 | 5.9 | .79 | 15.3 |
| | | | Average % Loss = 41.9 |

TABLE VII

| Characteristics of Slags Generated at 900°C | | | |
|---|---|---|---|
| $\frac{Na}{Pb+V}$ Ratio | Wt. Deposit (mg) | $\frac{\text{Wt. Deposit}}{\text{Surface Area}}$ $\frac{mg}{Cm^2}$ | % Loss on Brushing |
| | $\frac{Mg}{Pb + V} = 4$ $\frac{Pb}{V} = 1$ | | |
| 0.01 | 6.9 | 1.35 | 2.9 |
| 0.1 | 5.5 | 1.18 | 3.2 |
| 1.0 | 8.1 | 1.33 | 0 |
| 2.5 | 19.1 | 3.40 | 0 |
| | $\frac{Mg}{Pb + V} = 4$ $\frac{Pb}{V} = 0.5$ | | |
| 0.01 | 4.8 | 0.64 | 4.2 |
| 0.1 | 5.1 | 0.84 | 0 |
| 1.0 | 4.7 | 0.93 | 0 |
| 2.5 | 19.8 | 3.91 | 0 |
| | $\frac{Mg}{Pb + V} = 4$ $\frac{Pb}{V} = 1.5$ | | |
| 0.01 | 2.8 | 0.52 | 3.6 |
| 0.1 | 6.4 | 1.14 | 0 |
| 1.0 | 17.1 | 2.82 | 0 |
| 2.5 | 20.6 | 2.78 | 0 |
| | $\frac{Mg + Si}{Pb + V} = 4$ $\frac{Pb}{V} = 1$ | | |
| 0.01 | 8.3 | 1.41 | 13.3 |
| 0.1 | 7.9 | 1.56 | 1.3 |
| 1.0 | 8.4 | 1.67 | 0.0 |
| 2.5 | 27.0 | 3.67 | 0.0 |
| | $\frac{Mg + Si}{Pb + V} = 4$ $\frac{Pb}{V} = 0.5$ | | |
| 0.01 | 4.2 | 0.83 | 16.6 |
| 0.1 | 10.3 | 1.83 | 4.9 |
| 1.0 | 11.1 | 1.58 | 3.6 |
| 2.5 | 19.2 | 3.03 | 0.0 |
| | $\frac{Mg + Si}{Pb + V} = 4$ $\frac{Pb}{V} = 1.5$ | | |

TABLE VII-continued

| Characteristics of Slags Generated at 900°C | | | |
|---|---|---|---|
| $\frac{Na}{Pb+V}$ Ratio | Wt. Deposit (mg) | $\frac{\text{Wt. Deposit}}{\text{Surface Area}}$ $\frac{mg}{Cm^2}$ | % Loss on Brushing |
| 0.01 | 7.9 | 1.07 | 11.4 |
| 0.1 | 7.2 | 1.03 | 4.2 |
| 1.0 | 12.6 | 2.25 | 0.0 |
| 2.5 | 26.1 | 4.32 | 0.0 |
| | $\frac{Mg}{Pb+V} = 6$ | $\frac{Pb}{V} = 1$ | |
| 0.01 | 8.2 | 1.32 | 6.1 |
| 0.1 | 12.7 | 1.82 | 10.2 |
| 1.0 | 23.6 | 3.91 | 2.1 |
| 2.5 | 34.7 | 6.18 | 5.5 |
| | $\frac{Mg}{Pb+V} = 6$ | $\frac{Pb}{V} = 0.5$ | |
| 0.01 | 10.7 | 1.46 | 17.7 |
| 0.1 | 11.0 | 1.76 | 12.7 |
| 1.0 | 18.7 | 2.98 | 1.1 |
| 2.5 | 28.1 | 5.05 | 0.0 |
| | $\frac{Mg}{Pb+V} = 6$ | $\frac{Pb}{V} = 1.5$ | |
| 0.01 | 6.7 | 0.97 | 7.5 |
| 0.1 | 6.9 | 1.24 | 26.0 |
| 1.0 | 18.9 | 3.15 | 3.2 |
| 2.5 | 16.7 | 3.15 | 0.6 |
| | $\frac{Mg+Si}{Pb+V} = 6$ | $\frac{Pb}{V} = 1$ | |
| 0.01 | 7.5 | 1.35 | 25.3 |
| 0.1 | 10.2 | 1.63 | 8.8 |
| 1.0 | 18.8 | 2.72 | 0.5 |
| 2.5 | 21.4 | 3.84 | 0.9 |
| | $\frac{Mg+Si}{Pb+V} = 6$ | $\frac{Pb}{V} = 0.5$ | |
| 0.01 | 12.3 | 1.97 | 17.9 |
| 0.1 | 10.2 | 1.70 | 2.0 |
| 1.0 | 21.7 | 3.85 | 2.3 |
| 2.5 | 34.0 | 5.46 | 1.5 |
| | $\frac{Mg+Si}{Pb+V} = 6$ | $\frac{Pb}{V} = 1.5$ | |
| 0.01 | 11.2 | 1.53 | 50.0 |
| 0.1 | 13.4 | 1.82 | 44.0 |
| 1.0 | 16.0 | 2.86 | 3.1 |
| 2.5 | 26.9 | 4.78 | 0.0 |

TABLE VIII

CORROSION RATE DATA FOR UDIMET 500 IN $Na_2SO_4$—$CaSO_4$—$Al_2O_3$—PbO SLAGS

| Ratio | | | Mole Percent | | | | Icorr | | | | Slag Washability |
|---|---|---|---|---|---|---|---|---|---|---|---|
| Na/Pb | Ca/Pb | Al/Pb | $Na_2SO_4$ | $CaSO_4$ | $Al_2O_3$ | PbO | 800 | 850 | 900 | 950°C | |
| 10 | 0.5 | 0.5 | 89.114 | 5.112 | 3.797 | 1.978 | .734 | 1.18 | 3.18 | 4.90 | Poor |
| 10 | 1.5 | 1.5 | 75.638 | 13.016 | 9.667 | 1.679 | 1.12 | 1.91 | 2.79 | 3.40 | Poor |
| 10 | 2.5 | 2.5 | 65.703 | 18.843 | 13.996 | 1.458 | .931 | 1.67 | 2.16 | 2.94 | Poor |
| 1 | 0.5 | 0.5 | 45.014 | 25.820 | 19.177 | 9.989 | .0014 | .0028 | .0028 | .0028 | Poor |
| 1 | 1.5 | 1.5 | 23.692 | 40.769 | 30.281 | 5.258 | .0202 | .0323 | .0484 | .0706 | Poor |
| 1 | 2.5 | 2.5 | 16.077 | 46.109 | 34.246 | 3.568 | 1.81 | 2.95 | 5.00 | 6.66 | Fair |
| 0.1 | 0.5 | 0.5 | 7.567 | 43.404 | 32.237 | 16.792 | .68 | .91 | 5.66 | 6.49 | Poor |
| 0.1 | 1.5 | 1.5 | 3.011 | 51.819 | 38.487 | 6.683 | .0064 | .0115 | .0255 | .041 | Good |
| 0.1 | 2.5 | 2.5 | 1.880 | 53.909 | 40.040 | 4.171 | .0085 | .0198 | .031 | .156 | Good |
| 0.01 | 0.5 | 0.5 | 0.812 | 46.575 | 34.593 | 18.020 | .0028 | .0083 | .029 | .055 | Good |
| 0.01 | 1.5 | 1.5 | 0.310 | 53.262 | 39.559 | 6.869 | .0031 | .018 | .024 | .032 | Good |
| 0.01 | 2.5 | 2.5 | 0.191 | 54.837 | 40.729 | 4.243 | .0042 | .0042 | .0056 | .0112 | Good |

TABLE IX

CORROSION RATE DATA FOR UDIMET 500 IN $Na_2SO_4$—$CaSO_4$—$Al_2O_3$—$PbSO_4$ SLAGS

| Ratio | | | Mole Percent | | | | Icorr | | | | Slag Washability |
|---|---|---|---|---|---|---|---|---|---|---|---|
| Na/Pb | Ca/Pb | Al/Pb | $Na_2SO_4$ | $CaSO_4$ | $Al_2O_3$ | $PbSO_4$ | 800 | 850 | 900 | 950°C | |
| 10 | 0.5 | 0.5 | 89.114 | 5.112 | 3.797 | 1.978 | .281 | .359 | .468 | .858 | Fair |
| 10 | 1.5 | 1.5 | 75.638 | 13.016 | 9.667 | 1.679 | — | — | — | — | Good |

TABLE IX-continued

CORROSION RATE DATA FOR UDIMET 500 IN $Na_2SO_4$—$CaSO_4$—$Al_2O_3$—$PbSO_4$ SLAGS

| Ratio | | | Mole Percent | | | | Icorr | | | | Slag Washability |
|---|---|---|---|---|---|---|---|---|---|---|---|
| Na/Pb | Ca/Pb | Al/Pb | $Na_2SO_4$ | $CaSO_4$ | $Al_2O_3$ | $PbSO_4$ | 800 | 850 | 900 | 950°C | |
| 10 | 2.5 | 2.5 | 65.703 | 18.843 | 13.996 | 1.458 | .039 | .052 | .058 | .078 | Good |
| 1 | 0.5 | 0.5 | 45.014 | 25.820 | 19.177 | 9.989 | .302 | .414 | 1.2 | 1.7 | Fair |
| 1 | 1.5 | 1.5 | 23.692 | 40.769 | 30.281 | 5.258 | .15 | .29 | .62 | 1.34 | Good |
| 1 | 2.5 | 2.5 | 16.077 | 46.109 | 34.246 | 3.568 | .0015 | .0023 | .0023 | .0023 | Good |
| 0.1 | 0.5 | 0.5 | 7.567 | 43.404 | 32.237 | 16.792 | .099 | .46 | .76 | .91 | Fair |
| 0.1 | 1.5 | 1.5 | 3.011 | 51.819 | 38.487 | 6.683 | .0226 | .0311 | .0410 | .0566 | Good |
| 0.1 | 2.5 | 2.5 | 1.880 | 53.909 | 40.040 | 4.171 | .039 | .052 | .058 | .078 | Good |
| 0.01 | 0.5 | 0.5 | 0.812 | 46.575 | 34.593 | 18.020 | .0391 | .0521 | .0586 | .0652 | Good |
| 0.01 | 1.5 | 1.5 | 0.310 | 53.262 | 39.559 | 6.869 | .0182 | .0364 | .0486 | .0546 | Good |
| 0.01 | 2.5 | 2.5 | 0.191 | 54.837 | 40.729 | 4.243 | .0091 | .013 | .018 | .025 | Good |

We claim:

1. A composition comprising a hydrocarbon fuel oil containing corrosive amounts of lead, a lead-vanadium mixture or a lead-vanadium-sodium mixture and corrosion inhibiting amounts of metallic magnesium, calcium, aluminum, silicon or combinations thereof.

2. The hydrocarbon fuel oil composition of claim 1 where the corrosion inhibitor is magnesium.

3. The hydrocarbon fuel oil composition of claim 2 where the corrosive material is lead and the ratio of magnesium to lead is about 3.

4. The hydrocarbon fuel oil composition of claim 1 where the corrosion inhibitor is a mixture of magnesium and silicon.

5. The hydrocarbon fuel oil composition of claim 4 where the corrosive material is lead, the ratio of magnesium to lead being at least about 1.5 and the ratio of silicon to lead being at least about 1.5.

6. The hydrocarbon fuel oil composition of claim 1 where the corrosive material is a mixture of lead, vanadium and sodium and the corrosion inhibitor is a mixture of magnesium and silicon where the ratio of magnesium plus silicon to lead plus vanadium is at least about 4 and the ratio of sodium to lead plus vanadium is about 0.1 to about 0.125.

7. The hydrocarbon fuel oil composition of claim 1 where the corrosive material is a mixture of lead, vanadium and sodium and the corrosion inhibitor is calcium and aluminum where the ratio of calcium plus aluminum to lead plus vanadium is at least about 3 and the sodium to lead plus vanadium ratio is less than about 0.1.

8. The hydrocarbon fuel oil composition of claim 7 where there is also present silicon in a ratio of silicon to lead of about 1 to about 4.

9. The hydrocarbon fuel oil composition of claim 1 where the corrosive material is a mixture of lead, vanadium and sodium and the corrosion inhibitor is aluminum, the ratio of aluminum to lead plus vanadium ranging from about 2 to about 6 and the ratio of sodium to lead plus vanadium ranging from about 0.01 to about 0.1.

10. The hydrocarbon fuel oil composition of claim 1 where the corrosive material is lead and the corrosion inhibitor is a mixture of magnesium and aluminum where the ratios of magnesium to lead and aluminum to lead ranges from 1 to about 4.

11. The hydrocarbon fuel of claim 10 where there may also be present silicon, the ratio of silicon to lead ranging from about 1 to about 4.

12. A process for inhibiting corrosion in a hydrocarbon fuel oil containing corrosive amounts of lead, a lead-vanadium mixture or a lead-vanadium-sodium mixture which comprises adding to said fuel oil corrosion inhibiting amounts of metallic magnesium, calcium, aluminum, silicon or combinations thereof.

13. The process of claim 12 where the corrosion inhibitor is magnesium.

14. The process of claim 13 where the fuel oil contains lead as the corrosive material and the magnesium is added in a ratio of magnesium to lead of about 3.

15. The process of claim 12 where the fuel oil corrosion inhibitor added is a mixture of magnesium and silicon.

16. The process of claim 15 where the fuel oil contains lead as the corrosive material and the magnesium and silicon are each added in a ratio of magnesium to lead and silicon to lead of at least about 1.5.

17. The process of claim 12 where the fuel oil contains a mixture of lead, vanadium and sodium as the corrosive material and the corrosion inhibitor added is a mixture of magnesium and silicon in a ratio of magnesium plus silicon to lead plus vanadium of at least about 4 and the ratio of sodium to lead plus vanadium is about 0.1 to about 0.125.

18. The process of claim 12 where the fuel oil contains a mixture of lead, vanadium and sodium as the corrosive material and the corrosion inhibitor added is a mixture of calcium and aluminum in a ratio of calcium plus aluminum to lead plus vanadium of at least about 3 and the ratio of sodium to lead plus vanadium is less than about 0.1.

19. The process of claim 18 where there is also added silicon in a ratio of silicon to lead of about 1 to about 4.

20. The process of claim 12 where the fuel oil contains a mixture of lead, vanadium and sodium as the corrosive material and the corrosion inhibitor added is aluminum in a ratio of aluminum to lead plus vanadium ranging from about 2 to about 6 and the ratio of sodium to lead plus vanadium ranges from about 0.01 to about 0.1.

21. The process of claim 12 where the fuel oil contains lead as the corrosive material and the corrosion inhibitor added is a mixture of magnesium and aluminum in a ratio of magnesium to lead and aluminum to lead of about 1 to about 4.

22. The process of claim 21 where there is also added silicon in a ratio of silicon to lead of about 1 to about 4.

* * * * *